US005857638A

United States Patent [19]

Hermanns et al.

[11] Patent Number: 5,857,638

[45] **Date of Patent: *Jan. 12, 1999**

[54] METHOD AND DEVICE FOR PREPARING RANDOMLY CROSS-WOUND YARN PACKAGES

[75] Inventors: Ferdinand-Josef Hermanns, Erkelenz; Andreas Krüger, Mönchengladbach; Torsten Forche; Stefan Terörde, both of Dingden; Heinrich Weingarten, Krefeld, all of Germany

[73] Assignee: W. Schlafhorst AG & Co., Monchen-Gladbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 810,186

[22] Filed: Mar. 3, 1997

[30] Foreign Application Priority Data

Mar. 1, 1996 [DE] Germany ..... 196 07 905.5

[51] Int. Cl.[6] ..... B65H 54/38

[52] U.S. Cl. ..... 242/477.6; 242/477.4

[58] Field of Search ..... 242/18.1, 18 DD, 242/43 R, 477.5, 477.6, 477.7, 477.8, 486.4

[56] References Cited

U.S. PATENT DOCUMENTS

| | | | |
|---|---|---|---|
| 4,504,021 | 3/1985 | Schippers et al. | 242/18.1 |
| 4,515,320 | 5/1985 | Slavik et al. | 242/43 R X |
| 4,771,961 | 9/1988 | Sugioka | 242/18.1 |
| 4,805,844 | 2/1989 | Hermanns et al. | 242/18 DD |
| 5,035,370 | 7/1991 | Hermanns | 242/18.1 |
| 5,090,633 | 2/1992 | Ohashi | 242/18.1 |

FOREIGN PATENT DOCUMENTS

| | | | |
|---|---|---|---|
| 0 093 258 A2 | 11/1983 | European Pat. Off. . | |
| 28 55 616 A1 | 6/1980 | Germany . | |
| 23 19 282 B2 | 2/1981 | Germany . | |
| 37 03 869 A1 | 8/1988 | Germany . | |
| 39 16 918 A1 | 11/1990 | Germany . | |
| 42 39 579 A1 | 5/1994 | Germany . | |
| 195 19 542 A1 | 1/1996 | Germany . | |
| 5-178537 | 7/1993 | Japan . | |
| 07187500 | 7/1995 | Japan . | |
| 1601059 | 10/1990 | U.S.S.R. | 242/18 DD |

*Primary Examiner*—Michael Mansen

*Attorney, Agent, or Firm*—Kennedy Covington Lobdell & Hickman

[57] ABSTRACT

A friction roller of a winding station of a winding machine is driven at a base angular velocity and is alternately accelerated and braked when the winding ratio is otherwise within a predetermined range of a selected whole number for causing slippage between the friction roller and a yarn package whereby the winding ratio is changed between values above and below the preselected range of the whole number. An evaluation device that calculates acceleration and braking values and a motor responsive to the evaluation device for driving the friction roller control the accelerating and decelerating of the friction roller when the winding ratio would otherwise be within the predetermined range of the selected whole number. Pattern windings of the yarn package are thus avoided.

26 Claims, 1 Drawing Sheet

METHOD AND DEVICE FOR PREPARING RANDOMLY CROSS-WOUND YARN PACKAGES

FIELD OF THE INVENTION

The invention relates to a method for preparing randomly cross-wound yarn packages at a winding station of a winding machine having a friction roller for driving the yarn package and a traversing yarn guide arrangement for traversing of the yarn being wound onto the package at a traversing frequency directly related to the angular velocity of the friction roller whereby a winding ratio representing the relationship between the number of revolutions of the yarn package for each back and forth traverse of the yarn is defined, the winding ratio decreasing as the yarn package diameter increases. The invention further relates to a device for performing the method.

BACKGROUND OF THE INVENTION

When producing cylindrical or conical randomly cross-wound yarn packages, the winding ratio, i.e., the number of revolutions of the yarn package for each back and forth traverse of the yarn being wound, hyperbolically decreases as a function of time when the circumferential speed of the yarn package is maintained constant. Within defined ranges or areas when the winding ratio assumes a whole number value (hereinafter "pattern zone"), so-called winding patterns or mirrors are generated on the yarn package being wound. During time periods of these pattern zones the yarn of several successive wound layers tend to lie on top of each other or to lie very close to each other and result in the yarn package being compacted so that during a dyeing process, for example, irregular dyeing occurs. A further problem is that the yarn which lie on top of or close to each other tend to slip laterally off and become wedged in between each other greatly diminishing the unwinding properties of the yarn package.

It is well known to prevent the formation of yarn patterns during the winding process by means of pattern disruption methods or pattern disruption devices. For instance, to avoid these yarn winding patterns it is known from U.S. Pat. No. 5,035,370 and corresponding German Patent Publication DE 39 16 918 A1 to continuously accelerate and decelerate the angular velocity of a grooved drive drum in accordance with a predeterminable periodic function over short intervals starting from a base angular velocity, whereby slippage between the yarn package and the grooved drum occurs both during acceleration and deceleration.

In connection with a device having a friction roller embodied as a grooved roller, it is also known from German Patent Publication DE 42 39 579 A1 to determine with a computer by measurements of the angles of rotation of the yarn package and the grooved roller when, during the winding process, a pattern zone will be encountered causing the generation of yarn pattern windings. During the anticipated pattern zone the yarn package is partially braked relative to the grooved roller causing slippage therebetween, since the yarn package is forced to run at a slower circumferential speed than the grooved roller. However, once the pattern zone has been passed, the brake is released and the yarn package is again driven at the same circumferential speed as the grooved roller without slippage.

A winding device is also known from European Patent Publication EP-B 0 093 258, which has a friction roller that drives the yarn package and a traversing device which is independent thereof. The traversing speed of the traversing device is continuously changed between a maximum value and a minimum value. In addition, the mean value of the traversing speed is suddenly changed at a distance from an anticipated pattern zone so that generation of pattern windings is prevented. After having passed the anticipated time of the pattern zone, the mean value of the traversing speed is then returned to the former mean value.

OBJECT AND SUMMARY OF THE INVENTION

It is an object of the invention to provide a method that effectively suppresses the generation of yarn winding patterns and that is easy to realize, particularly in a winding machine having a plurality of winding stations each with a winding device.

This object is attained by alternately accelerating and decelerating a driven friction roller at least during an anticipated pattern zone in such a way that slippage is generated between the friction roller and the yarn package whereby the winding ratio is alternately changed between set values above and below the anticipated pattern zone. Outside of the pattern zone the friction roller is driven at a constant base angular velocity. In this way an effective pattern disruption is obtained without affecting the conventional driving of the friction roller outside of the pattern zones. It is therefore possible to operate at a constant circumferential speed outside of the patter zone, which is advantageous for the yarn tension in the formation of the yarn package.

In particular, the present invention includes a method for preparing randomly cross-wound yarn packages at a winding station of a winding machine, the steps of the method including: winding a yarn onto a package by driving a friction roller in peripheral contact with the package while traversing a yarn back and forth along the package with a yarn guide arrangement, the frequency of the traversing yarn being directly related to the angular velocity of the friction roller, whereby a winding ratio of the winding process representing the relationship between the number of revolutions of the yarn package for each back and forth traverse of the yarn is defined, the winding ratio decreasing as the bobbin diameter increases; and causing slippage between the friction roller and the yarn package by alternately accelerating and decelerating or braking the driven friction roller at least when the winding ratio would otherwise be within a predetermined range of a selected whole number (i.e., during a pattern zone) whereby the winding ratio is alternately changed between a predetermined value above and a predetermined value below the predetermined range of the selected whole number. Specifically, the method of the present invention includes the steps of: cross-winding a yarn onto a package by driving a friction roller at a generally constant angular velocity in peripheral contact with the package while traversing yarn back and forth along the package with a yarn guide arrangement; and causing the yarn package being wound to slip on the friction roller by alternately accelerating and decelerating the friction roller to a predetermined angular velocity above and a predetermined angular velocity below the base angular velocity when a winding ratio, which represents the relationship between the number of revolutions of the yarn package for each back and forth traverse of the yarn, would otherwise be within a predetermined range of a selected whole number.

In a feature of the method of the present invention, values representing the number of turns per unit time or periodic lengths of the friction roller and the yarn package are measured during a winding process and the times for reaching anticipated pattern zones are determined. This feature makes it possible to more precisely anticipate pattern zones. Moreover, pattern zones for which difficulties arise during unwinding of the yarn package if no pattern disruptions are performed, identified as critical pattern zones, can be singled out with pattern disruptions only needing to be necessarily performed during such critical pattern zones if not in all pattern zones.

In a further feature of the present invention it is provided that, for acceleration of the friction roller, an acceleration value is calculated from a value of the slip-free winding ratio measured during winding and a lower desired value of the winding ratio, which lies below a critical pattern zone and which is suitable for the generation of the slippage associated with the lower set value.

In a corresponding manner it is provided that for deceleration of the friction roller, a deceleration value is calculated from a measured value of the slip-free winding ratio measured during winding and an upper desired value of the winding ratio, which lies above the critical pattern zone and which is suitable for the generation of the slippage associated with the upper set value.

In yet a further feature of the present invention, the calculated acceleration value is compared with a predetermined minimum acceleration value and any further alternate accelerating and decelerating of the friction roller during the winding process is ceased if the calculated acceleration value is equal to or less than the predetermined minimal acceleration value.

In an embodiment of the present invention, a drive for accelerating and deceleration of the friction roller, which is driven at a base angular velocity, is provided for executing the method of the present invention. The drive is actuated by an evaluation device which forms the acceleration and the deceleration values during the pattern zones necessary for the slippage between the friction roller and the bobbin whereby the winding ratio is quickly changed between the set values above and below the pattern zone.

Further characteristic and advantages of the invention ensue from the following drawings and detailed description of the preferred method and embodiment of the present invention.

DETAILED DESCRIPTION OF THE PREFERRED METHOD AND EMBODIMENT

Figure 1:
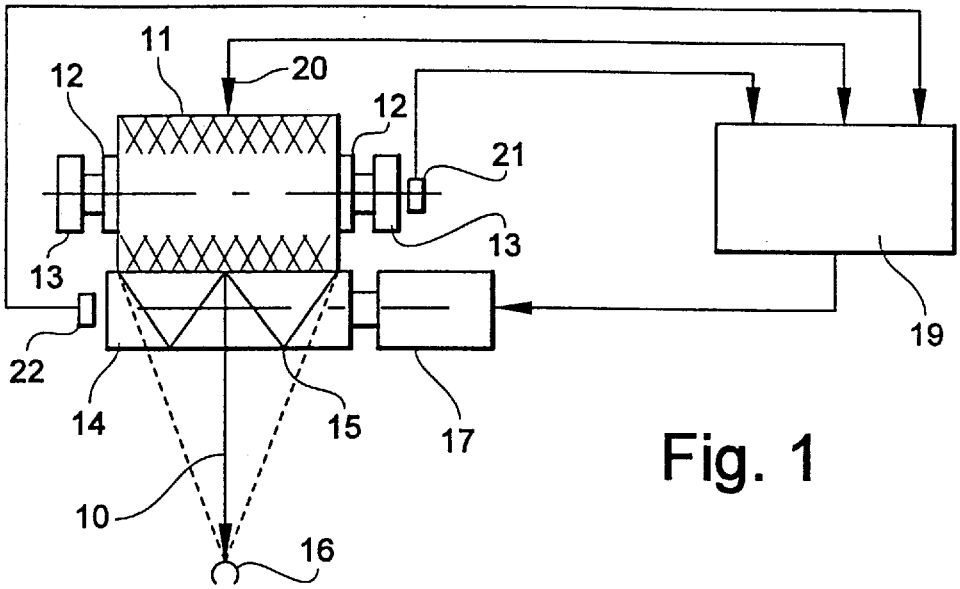
FIG. 1 is a schematic representation of a device for producing a randomly cross-wound yarn package with an associated control device for controlling the winding ratio for creating a pattern disruption during a pattern zone.

The winding device represented in FIG. 1 is a component of a winding station of an automatic winding machine, for example. Such an automatic winding machine has a plurality of winding stations, each of which has a winding device. A yarn 10 is wound onto a yarn package 11 by means of the winding device, the yarn package 11 having a bobbin case that is held in cone plates 12 seated in a creel 13. The creel 13 is pivotably seated and provided with a damping and load device, by means of which the yarn package 11 is pressed against a friction roller 14 with a steady force. The friction roller 14 is designed as a grooved roller having a yarn guide groove 15. The grooved roller in combination with a yarn guide 16 disposed ahead of the friction roller 14 acts as the traversing guide arrangement for the yarn, guiding the yarn in the groove 15 of the friction roller 14 back and forth along the yarn package. The friction roller 14 is driven by means of a brushless DC motor 17 at a base angular velocity. In place of an electronically controlled DC motor it is also possible to use an asynchronous motor embodied as an instantaneous actuator by means of trans-vector regulation. The traversing frequency of the yarn 10, i.e., the sequence of double lifts during traversing, remains at a fixed constant ratio to the angular velocity of the friction roller 14. A winding ratio can thereby be determined, i.e., the number of revolutions of the yarn package 11 per back and forth traverse of the yarn 10, which is a defined function that is hyperbolically reduced with increasing bobbin diameter.

Figure 2:
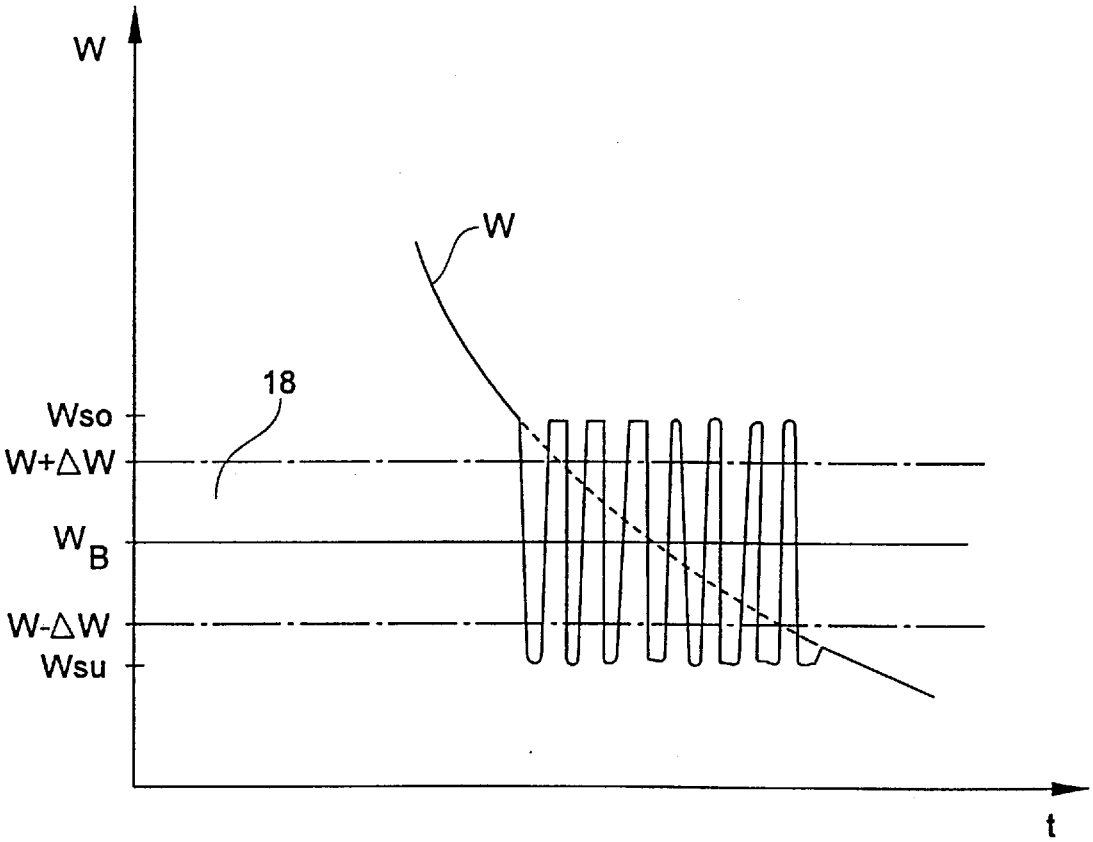
FIG. 2 is a diagram illustrating the resulting winding ratio over time associated with the device of FIG. 1 before, during, and after a pattern zone.

In FIG. 2 the winding ratio W has been plotted over the time t for a portion of a yarn package travel. If, for example, the winding ratio assumes a whole-number values $W_B$, so-called patterns are wound, wherein the yarn of successive wound layers lie on top of or close next to each other. A so-called pattern zone 18 results in this area of this whole-number winding ratio $W_B$ which is defined, for example, by the winding ratio $W_B \pm \blacktriangle W$. For example, $\blacktriangle W$ can be 0.005. Thus, yarn patterns would be wound in the area of the pattern zone 18, if the winding ratio W were to follow its course which is represented by the dashed line in FIG. 2 in the area of the pattern zone 18. Instead, however, as can be seen in FIG. 2, a pattern disruption method is applied in accordance with the present invention in the area of the pattern zone 18 by means of which the winding ratio W is suddenly switched between a lower set value $W_{su}$ and an upper set value $W_{so,}$ which values fall outside of the pattern zone 18, with the lower set value $W_{su}$ falling below the pattern zone 18 and the upper set value $W_{so}$ falling above the pattern zone 18. The chance of winding patterns is considerably reduced in this way. In the area ahead of and behind the pattern zone 18, winding takes place, for example, at a constant angular speed of the friction roller 14 and, therefore, with a steadily changing winding ratio W. In order to change the winding ratio W during the pattern zone 18, the friction roller 14 is respectively briefly accelerated and decelerated or braked in such a way that a slippage is created between the friction roller 14 and the yarn package 11, by means of which the winding ratio W is changed. Furthermore, acceleration and deceleration takes place in such a way that the winding ratio W jumps back and forth between the upper set value $W_{so}$ and the lower set value $W_{su}$, and in this process the pattern zone 18 is respectively quickly traversed.

Acceleration and deceleration of the friction roller 14 are performed in such a way that the preset value of the final stage of the DC motor 17 is varied in respect to the set value, which presets the base angular velocity. For example, the set value for the end stage of the DC motor 17 can be fixed in such a way that a circumferential speed of the friction roller 14 and thus a winding speed of 1000 m/min is obtained. By means of the variation of the preset value of the end stage of the DC motor it is then provided, for example, that during acceleration the circumferential speed and therefore the winding speed of the friction roller 14 is varied by ±70 m/min. In the process, acceleration and deceleration occurs so rapidly that a slippage is created between the friction roller 14 and the yarn package 11, which essentially continues to run at the same circumferential speed. By means of an evaluation device 19, the preset values are applied to the input of the end stage of the DC motor 17.

In a first feature of the present invention, the known pattern zones 18 occurring in the course of a yarn package winding are stored in the evaluation device 19. It is therefore possible to anticipate when a pattern zone 18 will be otherwise reached by means of evaluating the winding time, less occurring interruptions. Thus, since reaching the pattern zone 18 is to be expected after respectively preset periods of time, the disruption process, explained by means of FIG. 2, is triggered by decelerating and accelerating the friction roller at predetermined periods of time corresponding with the pattern zones. Moreover, in the present case the disrupting process by means of acceleration and decelerating of the friction roller 14 is preferably switched on and off at a distance ahead of and behind the respective pattern zone 18.

Since reaching the pattern zones 18 is a function of the diameter of the yarn package 11, it is provided in a further feature of the present invention to detect the respective diameter of the yarn package during winding by means of a measuring device 20 and to enter the measurement into the evaluation device 19.

For example, in the preferred embodiment of FIG. 1 the actual value of the winding ratio W in the evaluation device 19 is determined. An incremental sensor 21 is assigned to the yarn package 11 or to an element rotating along with it, for example, a cone plate 12. In the same way an incremental sensor 22 is assigned to the friction roller 14 or to an element rotating along with it, for example, the motor shaft of the DC motor 17. From the values of the incremental sensors 21, 22 the evaluation device 19 calculates the actual value of the winding ratio W, such as is known, for example, from German Patent Publication DE 42 39 579 A1. The evaluation device 19 then detects the reaching of a pattern zone, for example, the area around a whole-number winding ratio $W_B$, and triggers the pattern disruption process to begin.

As can be seen in FIG. 2, the area of a pattern zone 18 is approached from above during the winding process, i.e., from an area of a higher winding ratio. To change the winding ratio to an area below the pattern zone it is therefore necessary to perform a relatively strong acceleration. At the beginning of the reaching a pattern zone 18, however, only relatively light deceleration is necessary in order to again reach the area above the pattern zone. For this reason it is provided that the evaluation device 19 calculates the respective acceleration values and deceleration values for approaching the lower set value $W_{su}$ of the winding ratio and the upper set value $W_{so}$ of the winding ratio by means of acceleration and decelerating. In a first control stage an acceleration value is calculated on the basis of the actual value of the slip-free winding ratio W and the lower set value $W_{su}$, which is needed for reaching the lower set value $W_{su}$. For a predetermined time interval then the evaluation device 19 transmits a corresponding predetermined value to the input of the end stage of the DC motor 17. In a second control stage of the evaluation device 19 the value of deceleration or braking (retardation) required for calculating the upper set value $W_{so}$ is calculated from the actual slip-free winding ratio W and the upper set value $W_{so}$, which is then applied by the evaluation device 19 to the input of the DC motor 17 as a predetermined value for a predetermined length of time. As can be seen in FIG. 2, first a greater acceleration than deceleration is necessary to reach the lower set value $W_{su}$ and the upper set value $W_{so}$. When the whole-number winding ratio $W_B$ has been reached, the values for deceleration and acceleration are the same, while thereafter the value for deceleration becomes greater than the value for acceleration.

A minimum value for acceleration is stored in the evaluation device 19. When the acceleration value calculated for approaching the lower set value $W_{su}$ is equal to or less than the stored minimum acceleration value, the disruption process is stopped. In this case a winding ratio W is already achieved without additional acceleration of the friction roller 14, which is located outside the pattern zone 18.

It is practical to also consider the mass of the yarn package 11 when calculating the values for decelerating and acceleration, since with a small diameter of the yarn package 11 greater acceleration and deceleration of the friction roller 14 is required in order to cause slippage than with a yarn package 11 of greater diameter and correspondingly greater mass. The actual diameter and thus the actual mass of the yarn package 11 can be determined in the evaluation device 19 with the aid of the data from the incremental sensors 21, 22. However, it is also possible to enter these actual values directly into the evaluation device 19 by means of the diameter detection device 20.

In actual use it will be sufficient in many cases if acceleration and deceleration of the friction roller 14 by means of triggering its drive for the sudden change of the winding ratio W takes place only in the critical pattern zones 18. These critical pattern zones 18 are primarily in the area of the lower values of the whole-number winding ratio W, i.e., up to a value of W=4, while the value W=5 is not necessarily critical.

In a simple embodiment of the invention it is provided that the acceleration and deceleration of the friction roller is performed during a winding process in predefined areas. These areas can be predetermined, for example, by measuring the winding time or the yarn package diameter, and stored in the memory of a computer, so that pattern disruption is performed thereafter at predetermined times during the winding process. No measuring devices which detect the number of turns of the bobbin or the friction roller are required in this case.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for preparing randomly cross-wound yarn packages at a winding station of a winding machine, comprising:

winding a yarn onto a package by generally driving a friction roller in generally slip-free peripheral contact with the package while traversing a yarn back and forth along the package with a yarn guide arrangement, the frequency of the traversing yarn being directly related to the angular velocity of the friction roller, whereby a winding ratio of the winding process representing the relationship between the number of revolutions of the yarn package for each back and forth traverse of the yarn is defined, the winding ratio decreasing as the bobbin diameter increases, and causing slippage between the friction roller and the yarn package being wound by alternately accelerating and decelerating the driven friction roller when the winding ratio would otherwise be within a predetermined range of a selected whole number, whereby the winding ratio is alternately changed between a predetermined value above and a predetermined value below the predetermined range of the selected whole number.

2. A method of preparing cross-wound yarn packages comprising:

cross-winding a yarn onto a package by driving a friction roller with angular velocity in peripheral contact with the package while traversing yarn back and forth along the package with a yarn guide arrangement, and causing the yarn package being wound to slip on the friction roller by alternately accelerating and decelerating the friction roller to angular velocities above and below the base angular velocity when a winding ratio representing the relationship between the number of revolutions of the yarn package for each back and forth traverse of the yarn would otherwise be within a predetermined range of a selected whole number corresponding to a pattern zone whereby the winding ratio is alternately changed between predetermined values above and predetermined values below the predetermined range of the selected whole number.

3. The method in accordance with claims 1 or 2, wherein said accelerating and decelerating of the friction roller is performed when the winding ratio would otherwise be within a predetermined range of a plurality of selected whole numbers during the winding process.

4. The method in accordance with claims 1 or 2, further comprising detecting a value representing the frequencies and period lengths of the friction roller and the yarn package being wound during the course of the winding process to determine when the winding ratio would otherwise fall within the predetermined range of the selected whole number.

5. The method in accordance with claims 1 or 2, further comprising calculating a deceleration value from both a measured value representing a slip-free winding ratio during the winding process and a desired value of the winding ratio that is greater than winding ratios falling within the preselected range of the preselected whole number.

6. The method in accordance with claims 1 or 2, further comprising calculating an acceleration value from both a measured value representing a slip-free winding ratio during the winding process and a desired value of the winding ratio that is less than winding ratios falling within the preselected range of the preselected whole number.

7. The method in accordance with claim 6, further comprising comparing the calculated acceleration value with a predetermined minimum acceleration value and ceasing any further alternate accelerating and decelerating during the winding process when the calculated acceleration value is equal to or less than the predetermined minimal acceleration value.

8. The method in accordance with claims 1 or 2, wherein said step of alternately accelerating and decelerating the friction roller occurs at least twice during the pattern zone.

9. The method in accordance with claims 1 or 2, wherein the step of accelerating the friction roller includes accelerating the friction roller to a greater extent before the winding ratio would otherwise reach the selected whole number than after the winding ratio would otherwise be less than the selected whole number.

10. The method in accordance with claim 9, wherein the step of decelerating the friction roller includes decelerating the friction roller to a lesser extent before the winding ratio would otherwise reach the selected whole number than after the winding ratio would otherwise be less than the selected whole number.

11. A device for controlling the winding of a randomly cross-wound yarn package at a winding station of a winding machine having a friction roller for driving a yarn package being wound and a traversing guide for traversing of the yarn back and forth alongside the package at a frequency directly related to the angular velocity of the friction roller, whereby a winding ratio of the winding process representing the relationship between the number of revolutions of the yarn package for each back and forth traverse of the yarn is defined, the winding ratio decreasing as the bobbin diameter increases, the device comprising:

an evaluation device that calculates acceleration values and deceleration values for the friction roller when the winding ratio would otherwise fall within a predetermined range of at least one preselected whole number, and means actuated by said evaluation device for causing slippage between the friction roller and the yarn package by accelerating and decelerating the driven friction roller whereby the winding ratio is changed between predetermined values above and below the predetermined range of the selected whole number, and for driving the friction roller at a constant angular velocity when the winding ratio would not otherwise fall within a predetermined range of one of said preselected whole numbers.

12. The device in accordance with claim 11, wherein said means for accelerating and decelerating the friction roller comprises a brushless DC motor which has an end stage having an input that is connected to an output of said evaluation device.

13. A method for preparing randomly cross-wound yarn packages at a winding station of a winding machine, comprising:

(a) winding a yarn onto a package by driving with angular velocity a friction roller in peripheral contact with the package, (b) traversing a yarn back and forth along the package with a yarn guide arrangement at a frequency that is directly related to the angular velocity of the friction roller, whereby a winding ratio of the winding process representing the relationship between the number of revolutions of the yarn package for each back and forth traverse of the yarn is defined, and (c) when the winding ratio would otherwise be within a predetermined range of a selected whole number corresponding to a pattern zone, alternately decreasing the winding ratio to a predetermined value below the predetermined range of the selected whole number by accelerating the friction roller, and increasing the winding ratio to a predetermined value above the predetermined range of the selected whole number by decelerating the friction roller, said increasing of the winding ratio and said decreasing of the winding ratio each resulting in slippage between the friction roller and the yarn package, and said alternately increasing and decreasing the winding ratio resulting in slippage between the friction roller and the yarn package.

14. The method in accordance with claim 13, wherein said accelerating and decelerating of the friction roller is performed when the winding ratio would otherwise be within a predetermined range of a plurality of selected whole numbers during the winding process.

15. The method in accordance with claim 13, further comprising detecting a value representing the frequencies and period lengths of the friction roller and the yarn package being wound during the course of the winding process to determine when the winding ratio would otherwise fall within the predetermined range of the selected whole number.

16. The method in accordance with claim 13, further comprising calculating a deceleration value from both a measured value representing a slip-free winding ratio during the winding process and a desired value of the winding ratio that is greater than winding ratios falling within the preselected range of the preselected whole number.

17. The method in accordance with claim 13, further comprising calculating an acceleration value from both a measured value representing a slip-free winding ratio during the winding process and a desired value of the winding ratio that is less than winding ratios falling within the preselected range of the preselected whole number.

18. The method in accordance with claim 17, further comprising comparing the calculated acceleration value with a predetermined minimum acceleration value and ceasing any further alternate accelerating and decelerating during the winding process when the calculated acceleration value is equal to or less than the predetermined minimal acceleration value.

19. The method in accordance with claim 13, wherein said step of alternately accelerating and decelerating the friction roller occurs at least twice during the pattern zone.

20. The method in accordance with claim 13, wherein the step of accelerating the friction roller includes accelerating the friction roller to a greater extent before the winding ratio would otherwise reach the selected whole number than after the winding ratio would otherwise be less than the selected whole number.

21. The method in accordance with claim 20, wherein the step of decelerating the friction roller includes decelerating the friction roller to a lesser extent before the winding ratio would otherwise reach the selected whole number than after the winding ratio would otherwise be less than the selected whole number.

22. The method in accordance with claim 13, wherein said step of alternately increasing the winding ratio by decelerating the friction roller and decreasing the winding ratio by accelerating the friction roller includes suddenly alternating between accelerating the friction roller and decelerating the friction roller.

23. An apparatus for winding randomly cross-wound yarn packages comprising:

a friction roller for driving a yarn package being wound;

a traversing guide for traversing of the yarn back and forth alongside the package at a frequency directly related to the angular velocity of the friction roller, whereby a winding ratio of the winding process representing the relationship between the number of revolutions of the yarn package for each back and forth traverse of the yarn is defined, the winding ratio decreasing as the bobbin diameter increases;

an evaluation device that calculates acceleration values and deceleration values for the friction roller when the winding ratio would otherwise fall within a predetermined range of at least one preselected whole number; and means actuated by said evaluation device for causing slippage between the friction roller and the yarn package by accelerating and decelerating the driven friction roller whereby the winding ratio is changed between predetermined values above and below the predetermined range of the selected whole number.

24. The apparatus in accordance with claim 23, wherein said means for accelerating and decelerating the friction roller comprises a brushless DC motor which has an end stage having an input that is connected to an output.

25. The apparatus in accordance with claim 23, wherein said means for causing slippage between the friction roller and the yarn package suddenly alternates between accelerating and decelerating of the friction roller thereby causing slippage between the friction roller and the yarn package.

26. The apparatus in accordance with claim 23, wherein said means for causing slippage between the friction roller and the yarn package sufficiently accelerates the friction roller to cause slippage between the friction roller and the yarn package, and further sufficiently decelerates the friction roller to cause slippage between the friction roller and the yarn package.

* * * * *